US006748836B2

(12) United States Patent
Vivirito et al.

(10) Patent No.: US 6,748,836 B2
(45) **Date of Patent: *Jun. 15, 2004**

(54) DUAL SHARPENER APPARATUS FOR MAINTAINING THE SHARPNESS OF THE CUTTING EDGE ON BLADES USED TO CUT SHEET-TYPE WORK MATERIALS

(75) Inventors: Joseph R. Vivirito, South Windsor, CT (US); Richard Kuchta, Shickshinny, PA (US)

(73) Assignee: Gerber Technology, Inc., Tolland, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/227,596

(22) Filed: Jan. 8, 1999

(65) Prior Publication Data

US 2001/0049987 A1 Dec. 13, 2001

Related U.S. Application Data

(62) Division of application No. 09/007,412, filed on Jan. 15, 1998, now abandoned.

(51) Int. Cl.[7] ..... B26D 7/12

(52) U.S. Cl. ..... 83/174; 83/940; 451/58; 451/423

(58) Field of Search ..... 83/174, 174.1, 83/168, 169, 697, 747, 939, 940, 941; 451/58, 423, 428, 45, 419, 420, 421, 422, 57; 30/138, 139

(56) References Cited

U.S. PATENT DOCUMENTS

| | | | | | |
|---|---|---|---|---|---|
| 1,551,167 | A | * | 8/1925 | Orlow | 83/174 |
| 2,911,772 | A | * | 11/1959 | Gronemeier | 451/423 |
| 4,294,047 | A | * | 10/1981 | Pearl | 83/174 X |
| 4,643,061 | A | * | 2/1987 | Gerber | 83/174.1 |
| 4,732,064 | A | * | 3/1988 | Pearl | 83/174 X |
| 4,841,822 | A | * | 6/1989 | Gerber | 83/174 |
| 4,984,492 | A | * | 1/1991 | Gerber | 83/174.1 X |
| 5,044,238 | A | * | 9/1991 | Etcheparre et al. | 451/423 X |
| 5,067,378 | A | * | 11/1991 | Gerber | 83/174.1 X |
| 5,303,515 | A | * | 4/1994 | Etcheparre et al. | 83/174 X |
| 5,505,108 | A | * | 4/1996 | Kuchta et al. | 83/174 |
| 5,626,065 | A | * | 5/1997 | Cattini | 83/174 |

* cited by examiner

*Primary Examiner*—Clark F. Dexter
(74) *Attorney, Agent, or Firm*—McCormick, Paulding & Huber LLP

(57) ABSTRACT

A sheet material cutting apparatus includes a cutting head and a knife frame rotatably coupled to the cutting head. A blade defining a cutting edge is coupled for reciprocation to the knife frame, as is a primary sharpener for sharpening substantially the entire cutting edge of the blade after it becomes dull from operation. A presser foot having a secondary sharpener mounted thereon, is also coupled to the knife frame for movement between a raised non-working and a lowered working position. The secondary sharpener includes a sharpening member engageable with the cutting edge of the blade via the action of an actuator, for sharpening a portion of the blade's cutting edge between primary sharpening operations.

13 Claims, 7 Drawing Sheets

DUAL SHARPENER APPARATUS FOR MAINTAINING THE SHARPNESS OF THE CUTTING EDGE ON BLADES USED TO CUT SHEET-TYPE WORK MATERIALS

CROSS REFERENCE TO RELATED APPLICATION

This application is a divisional of U.S. patent application Ser. No. 09/007,412 entitled DUAL SHARPENER APPARATUS FOR MAINTAINING THE SHARPNESS OF THE CUTTING EDGE ON BLADES USED TO CUT SHEET-TYPE WORK MATERIALS, filed on Jan. 15, 1998, now abandoned.

FIELD OF THE INVENTION

The present invention relates generally to machines that employ reciprocating blades for cutting sheet-type work materials, and deals more particularly with an apparatus for performing a dual sharpening operation on the cutting edge of the blade, whereby a primary sharpener is used to sharpen the entire cutting edge of the blade, and a secondary sharpener is utilized between primary sharpening operations to sharpen only a portion of the cutting edge that initially becomes dull.

BACKGROUND OF THE INVENTION

Reciprocating blades are used to cut sheet type work materials in a variety of high-speed, large-volume cutting operations. For example, such blades are employed in reciprocating blade cutting heads used on cloth cutting machines where pattern pieces are simultaneously cut from one to several sheets of fabric stacked one-on-top-of-the-other. Due to the high throughput rates of this type of cutting machinery, the cutting edge of the blade becomes dull and requires sharpening at regular intervals.

In addition to the cutting edge becoming dull, another difficulty that sometimes occurs in high-speed, large-volume cutting machinery is that the geometry of the leading edge portion of the cutting edge becomes displaced relative to the remainder of the cutting edge. This is especially problematic in machinery where closed complex shapes are cut requiring the blade to turn in the same cutting direction in order to follow the outline of the closed piece shape. This overall net unidirectional change imparts a significant lateral load on the cutting edge of the blade causing a concomitant distortion in geometry, a phenomena referred to as "edge roll-over." This loss of geometric integrity causes further degradation of the blade's cutting edge to occur at an accelerated rate such that a complete sharpening of the entire cutting edge is required at an interval considerably shorter than that which would occur simply as a result of dulling. Each time the cutting edge is completely sharpened a significant amount of material is removed from the blade, causing a concomitant reduction in the blade's useful life. In addition, the time spent sharpening reduces throughput of the machine.

Based on the foregoing, it is the general object of the present invention to provide an apparatus for sharpening or reforming the cutting edge of a blade used in reciprocating blade cutting machines that overcomes the above-described drawbacks of prior sharpening devices.

It is a more specific object of the present invention to provide an apparatus for prolonging the period between which the entire surface of the cutting edge of a reciprocating blade used in cutting machines must be sharpened.

SUMMARY OF THE INVENTION

The present invention is directed to a sheet material cutting apparatus including a frame having a work supporting surface for carrying sheet-type work materials, such as one or more layers of fabric stacked one-on-top-of-the-other. The apparatus also includes a cutting head coupled to the frame adjacent to the work supporting surface. The cutting head includes a knife frame rotatably mounted thereon for rotation relative to the frame. An elongated blade is coupled for reciprocation to the knife frame and includes cutting surfaces that together define a cutting edge. The blade is movable between a lowered position, whereby the blade can engage the work material, and a raised position whereby the blade is located above the work material. Drive means are also associated with the cutting head for rotating the knife frame about an axis perpendicular to the work supporting surface to orient the cutting edge of the blade in a particular cutting direction. A primary sharpener is coupled to the knife frame and can be selectively engaged with at least one of the cutting surfaces while the blade reciprocates, thereby sharpening the blade by removing material along substantially the entire cutting edge.

A secondary sharpener, for maintaining the sharpness of the cutting edge of the blade between primary sharpening operations is also provided. The secondary sharpener is coupled to a presser foot, which in turn is coupled to the knife frame. The presser foot is moveable between a lowered working position where it engages and exerts pressure on the sheet-type work material, and a raised non-working position whereby the presser foot is located above the work material. Between primary sharpening operations, with the presser foot in the non-working position, and the blade in the raised position, the secondary sharpener can be selectively engaged with a portion of at least one of the cutting surfaces of the blade to sharpen only that portion of the blade where degradation of the cutting edge generally initiates. Use of the secondary sharpener prolongs the life of the blade by extending the time between primary sharpening operations thereby minimizing the amount of material which must be removed from the blade's cutting edge to maintain sharpness. While the secondary sharpener is described above as being coupled to the presser foot, the present invention is not limited in this regard as the secondary sharpener can be mounted to the cutter head or frame without departing from the broader aspects of the present invention.

In a preferred embodiment of the present invention, the primary sharpener includes at least one abrasive grinding wheel coupled to the knife frame adjacent to the cutting edge of the blade. The grinding wheel can be selectively engaged with at least one of the cutting surfaces to remove material from the surface and thereby sharpen the blade. The secondary sharpener preferably includes a sharpening member slidably coupled to at least one guide-rail which in turn is coupled to the presser foot adjacent to the cutting edge of the blade. Biasing means mounted on the guide rail are interposed between the presser foot and the sharpening member to urge the sharpening member away from the cutting edge during a cutting operation. In addition, means for causing the secondary sharpener to selectively engage a portion of at least one of the cutting surfaces of the blade in response to commands issued from a controller are also included.

In one embodiment, the means for causing the secondary sharpener to selectively engage at least one of the cutting surfaces includes an actuating arm extending from the knife frame and having a tapered surface positioned adjacent to the sharpening member. As the presser foot is moved from the working to the non-working position, and the blade is moved to the raised position, the actuating arm progressively engages the sharpening member, urging it into contact with a portion of the cutting edge of the blade. As the blade is reciprocated, material is removed from the portion of the cutting edge by the sharpening member thereby sharpening the blade.

In another embodiment of the present invention, the means for causing the secondary sharpener to selectively engage the cutting edge of the blade includes an actuator, preferably in the form of a solenoid, a pneumatic cylinder, or a hydraulic cylinder coupled to the presser foot and in communication with the sharpening member. The actuator moves the sharpening member into engagement with a portion of the blade's cutting edge, in response to commands issued from the controller.

In yet a further embodiment of the present invention, the secondary sharpener is slidably positioned on the guide rail; biasing means, preferably in the form of a spring are interposed between the presser foot and the sharpening member for urging the sharpening member away from the blade during a cutting operation. The secondary sharpening operation is performed by moving the presser foot to the non-working position, and the blade to the raised position and then rotating the knife frame at a rate adequate to impart centrifugal force to the sharpening member of a magnitude sufficient to overcome the force exerted on the member by the spring. This in turn causes the sharpening member to engage and sharpen a portion of the cutting edge of the blade during reciprocation.

In yet a further embodiment of the present invention, at least one swing arm is pivotally coupled to the presser foot and the sharpening member. During a cutting operation, biasing means interposed between the swing arm and the presser foot, urge the sharpening member away from the blade's cutting edge. To perform a secondary sharpening operation, the presser foot is moved to the non-working position, the blade is raised, and the knife frame is rotated such that centrifugal force, adequate to overcome the force exerted against the swing arm by the biasing means, is imparted to the sharpening member causing the sharpening member to engage and sharpen a portion of at least one of the cutting surfaces of the reciprocating blade.

The sharpening member of the secondary sharpener can also include first and second blade shaping surfaces selectively engageable with opposing cutting surfaces which together define the cutting edge of the blade. Rotation of the knife frame in a first rotational direction imparts centrifugal force to the sharpening member causing the swing arm to pivot and the first blade shaping surface to engage a portion of one of the edge surfaces defined by the blade. Rotation of the knife frame in a second rotational direction, opposite to the first rotational direction, causes the second blade shaping surface to engage a portion of an opposite edge surface defined by the blade, thereby sharpening a portion of the cutting edge.

BRIEF DESCRIPTION OF THE DRAWINGS

These and other features, aspects, and advantages of the present invention will become better understood with regard to the following description, appended claims, and accompanying drawing where:

DETAILED DESCRIPTION OF THE PREFERRED EMBODIMENTS

Figure 1:
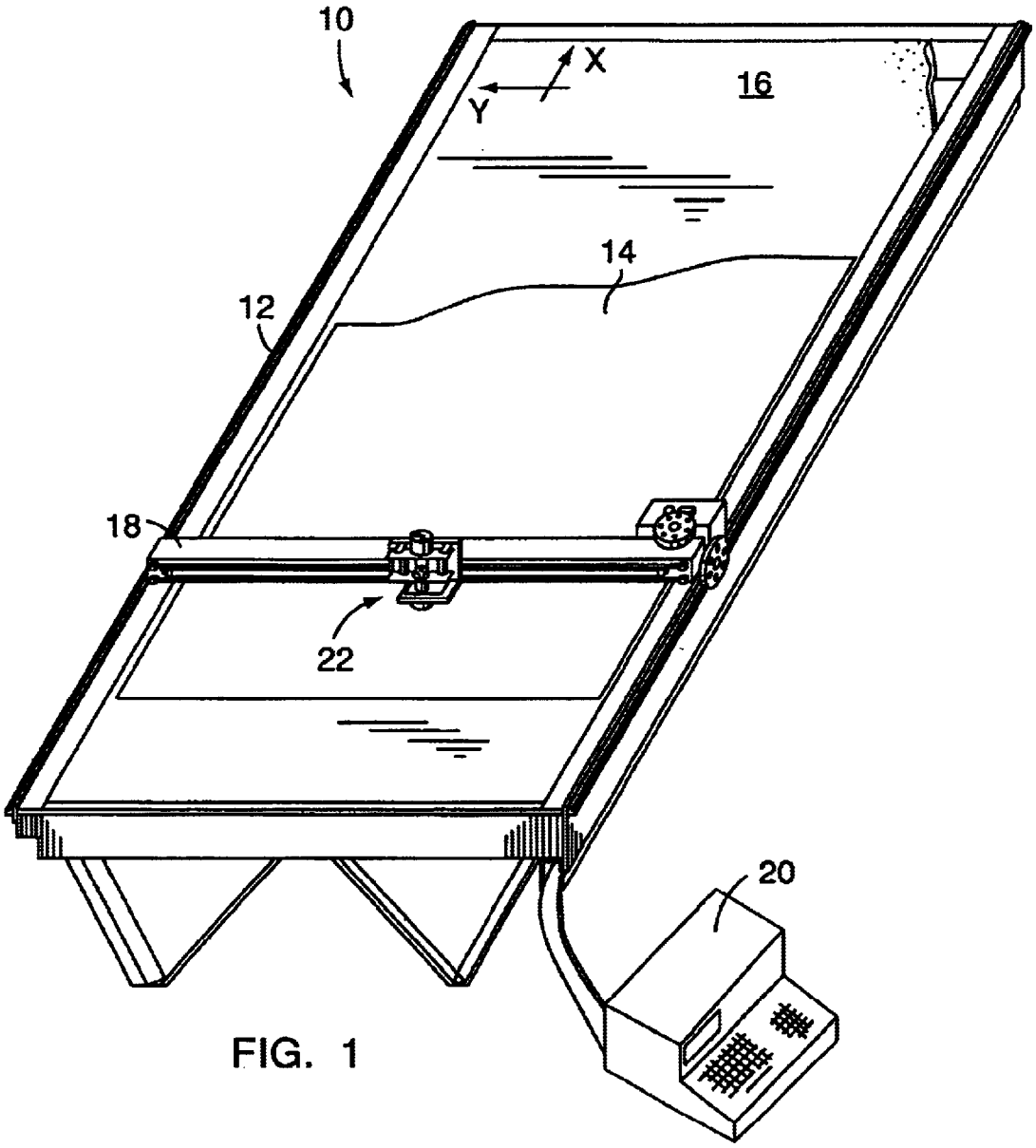
FIG. 1 is a perspective view of the sheet material cutting apparatus of the present invention.

Referring to FIG. 1, a sheet material cutting apparatus of the present invention generally designated by the reference number 10 includes a frame 12 having a work supporting surface 14 for carrying one or more layers of sheet material 16, such as, but not limited to fabric. An elongated support 18 is mounted on the frame 12 for movement in a first indicated coordinate direction (X) along the longitudinal axis of the sheet material 16, in response to commands issued from a controller 20. A cutting head 22 is slidably coupled to the elongated support 18 for movement across the width of the sheet material 16 in a second indicated coordinate direction (Y) approximately perpendicular to the first coordinate direction (X), in response to commands issued from the controller 20.

Figure 2:
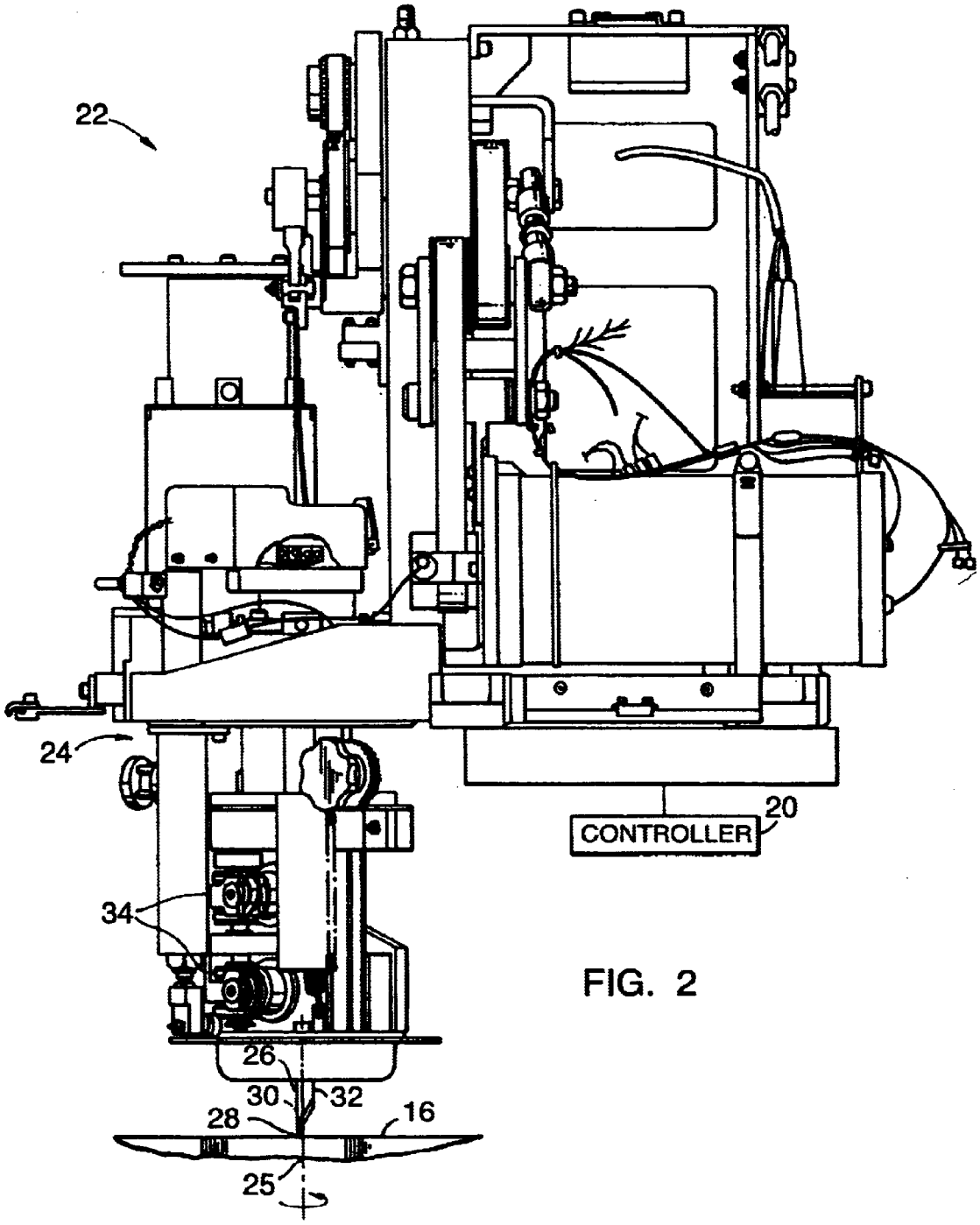
FIG. 2 is a side elevational view of the cutting head of the present invention showing an embodiment of a primary sharpener.
Figure 2A:
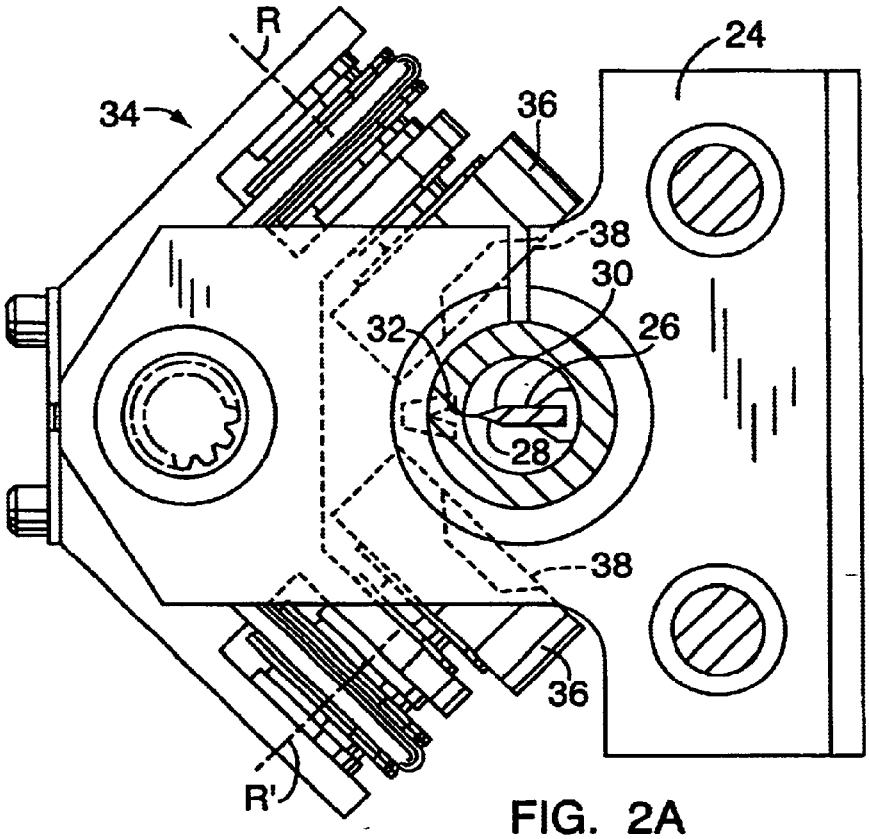
FIG. 2A is a partly in section plan view of the primary sharpener of FIG. 2.

As shown in FIGS. 2 and 2A, the cutting head 22 includes a knife frame 24 rotatable about an axis 25, and a knife or blade 26 that is coupled to the knife frame for reciprocation through a given stroke in response to commands issued from the controller 20. The blade 26 is movable between a lowered cutting position wherein the blade engages and cuts the sheet material 16, and a raised position whereby the blade is located above the sheet material 16. The blade includes first and second edge surfaces, 28 and 30 respectively, which together act to define a cutting edge 32. The cutting edge is maintained in a sharpened condition in part by the primary sharpener 34, explained in detail below.

Referring to FIG. 2A, the primary sharpener 34 is of the type shown and described in U.S. Pat. No. 5,609,082 (the '082 patent) to Kuchta, issued Mar. 11, 1997, assigned to the assignee of the present invention and incorporated by reference as part of the present disclosure. The primary sharpener 34 includes two abrasive grinding wheels 36 pivotally coupled to the knife frame 24 for rotation about the axes R and R'. The grinding wheels 36 each define an outwardly disposed face 38 juxtaposed relative to the first and second edge surfaces, 28 and 30 respectively, of the blade 26. During a primary sharpening operation, drive means (not shown) associated with the grinding wheels 36, cause the wheels to rotate, and the respective grinding wheel to pivot into engagement with either the first or second edge surfaces, 28 or 30 of the blade 26 in response to commands issued from the controller 20. The action of the rotating grinding wheel 36 and the reciprocating blade 26 causes material to be removed along substantially the entire cutting edge.

Figure 4:
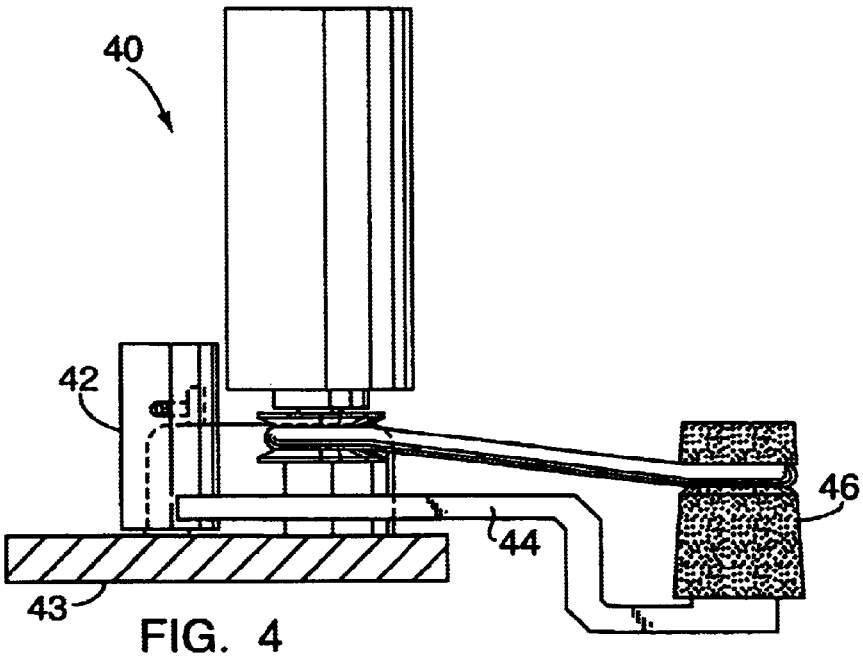
FIG. 4 is an enlarged partial view of the cutting head of FIG. 3 showing the primary sharpener of FIG. 3.
Figure 3:
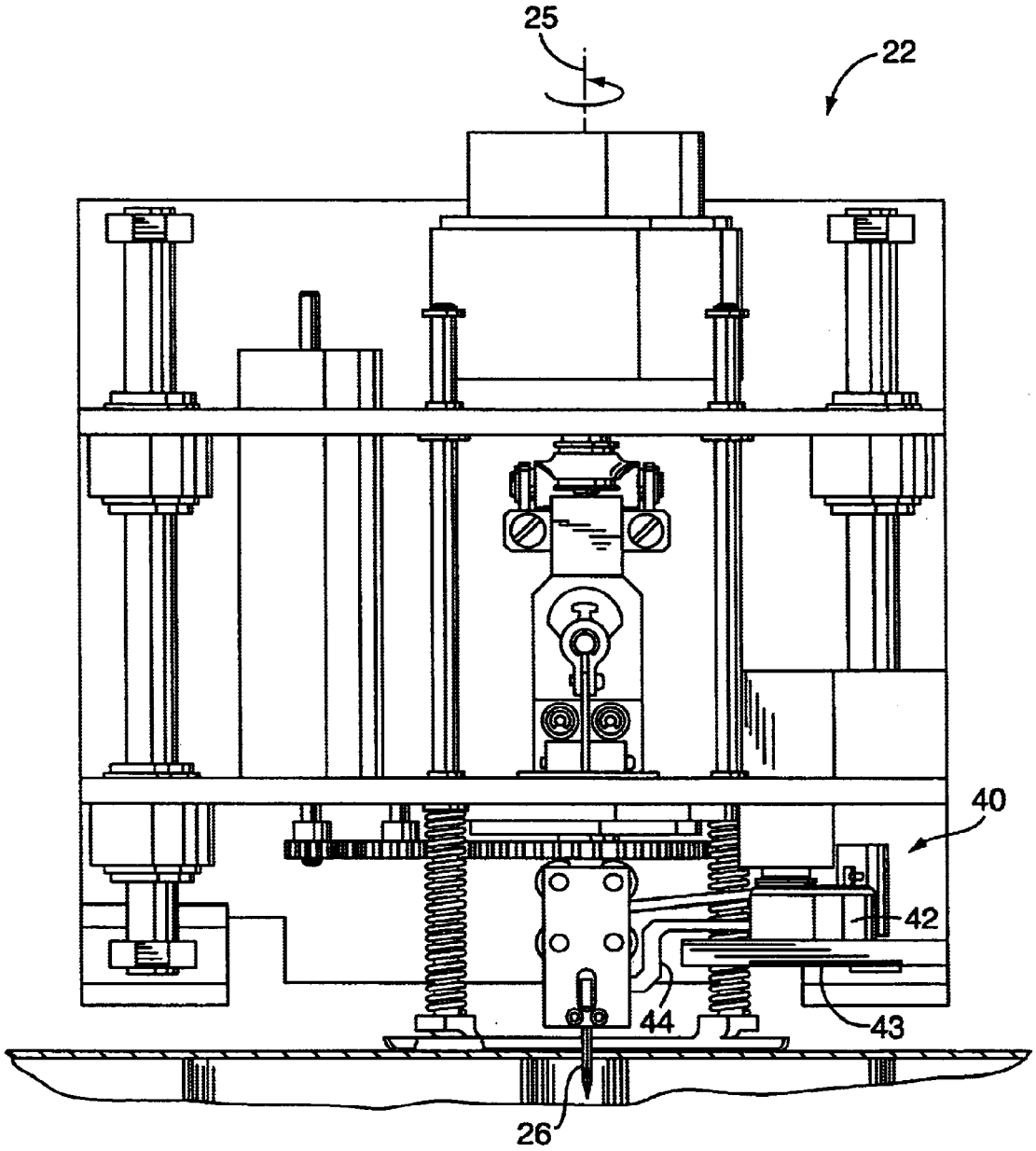
FIG. 3 is a front elevational view of a cutting head of the present invention including an alternate embodiment of the primary sharpener of FIG. 2.

While the primary sharpener has been described as including a pair of grinding wheels, the invention is not limited in this regard as other primary sharpeners that selectively engage the blade 26 during reciprocation can be substituted without departing from the broader aspects of the present invention. One such sharpener shown in FIGS. 3 and 4, and generally designated by the reference numeral 40 is of the type shown and described in U.S. Pat. No. 4,841,822 (the '822 patent) to Gerber issued Jun. 27, 1989, and assigned to the assignee of the present invention. The '822 patent is hereby incorporated by reference as part of the present disclosure. The sharpener 40 includes a hub 42 rotatably coupled to a tool carriage 43 mounted on the cutting head. An arm 44 is coupled to the hub 42 and extends toward the blade 26. A sharpening wheel 46 is rotatably coupled to an end of the arm 44, and is rotatably driven in response to commands received from the controller 20, by a suitable means such as a motor. The sharpener 40 also includes a spring (not shown) coupled to the arm 44 and the tool carriage 43 for urging the sharpening wheel 46 away from the blade 26 during a cutting operation. During a primary sharpening operation, the blade 26 is moved to the raised position and the hub 42 pivots in response to commands issued from the controller causing the rotating sharpening wheel 46 to engage the reciprocating blade 26, thereby removing material from the blade's cutting edge 32 and sharpening the blade.

Figure 5:
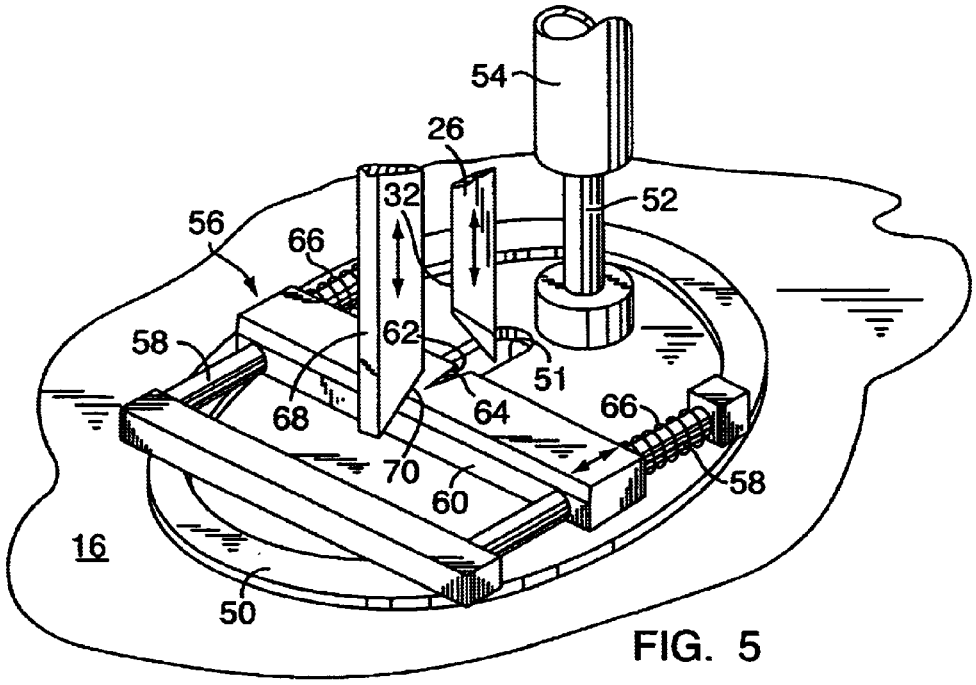
FIG. 5 is a partial perspective view of an embodiment of the secondary sharpening apparatus of the present invention.

As shown in FIG. 5, the cutting head 22 also includes a presser foot 50 coupled to the knife frame 24, and defining a slot 51 through which the blade 26 passes. Sliding members 52 (one shown) are coupled to the presser foot 50 and telescopically engage mating members 54 extending from the knife frame 24, such that the presser foot can move between a lowered working position, whereby the presser foot exerts pressure on the sheet material, and a raised non-working position whereby the presser foot is located above the sheet material, in response to commands issued from the controller 20. A secondary sharpener generally designated by the reference numeral 56 is coupled to the presser foot for sharpening a portion of the cutting edge 32 of the blade 26 between primary sharpening operations. The secondary sharpener 56 includes a pair of guide rails 58 coupled to the presser foot 50, and located opposite to one another with the blade 26 interposed therebetween. A sharpening member 60 defining first and second sharpening surfaces, 62 and 64 respectively, which together form a V-shaped notch of a shape complementary to the cutting edge 32 of the blade 26, is slidably mounted on the guide rails 58. A spring 66 is positioned over each of the guide rails 58 between the sharpening member 60 and the presser foot 50 for urging the sharpening member away from the blade 26 during a cutting operation.

While the sharpening member 60 is shown and described in the illustrated embodiment as including a V-shaped notch, the present invention is not limited in this regard. The sharpening member 60 can also take the form of a grinding wheel or sharpening stone, without departing from the broader aspects of the present invention.

Still referring to FIG. 5, an actuating arm 68 is coupled to, and extends downwardly from the knife frame 24. The arm 68 defines a tapered surface 70 positioned adjacent to the sharpening member 60. A secondary sharpening operation, separate and distinct from the primary sharpening operation, is performed by raising the blade 26 and the presser foot 50 to the non-working position, thereby causing the tapered surface 70 of the actuating member 68 to progressively engage the sharpening member 60, urging the sharpening member into engagement with a portion of the cutting edge 32 of the blade 26. Additionally, the actuating arm 68 can be moved relative to the presser foot 50 as shown by the double arrow in FIG. 5 to urge the sharpening member 60 into engagement with a portion of the cutting edge 32 of the blade 26. As the blade 26 reciprocates, the sharpening member 60 and the blade coact to redefine the geometry of the engaged portion of the cutting edge 32 of the blade 26; and to sharpen the engaged portion of the blade's cutting edge 32, preferably without significant removal of material.

Figure 6:
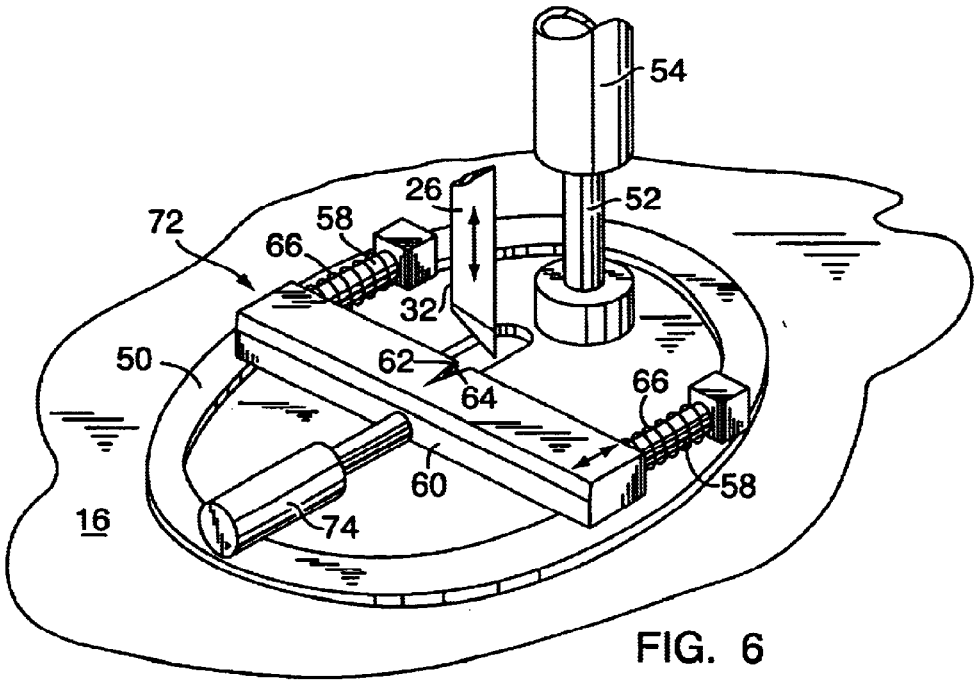
FIG. 6 is a partial perspective view of an embodiment of the secondary sharpening apparatus of the present invention.

As shown in FIG. 6, instead of an actuating arm 68, the secondary sharpener generally designated by the reference numeral 72 includes a pneumatic cylinder 74 coupled to the presser foot 50 adjacent to, and in communication with the sharpening member 60. The pneumatic cylinder 74 moves the sharpening member into engagement with the portion of the cutting edge of the blade 26 in response to commands issued from the controller 20. While a pneumatic cylinder 74 has been shown and described, the present invention is not limited in this regard as other means for actuating the sharpening member, such as solenoids or hydraulic cylinders can be substituted without departing from the broader aspects of the invention.

Figure 7:
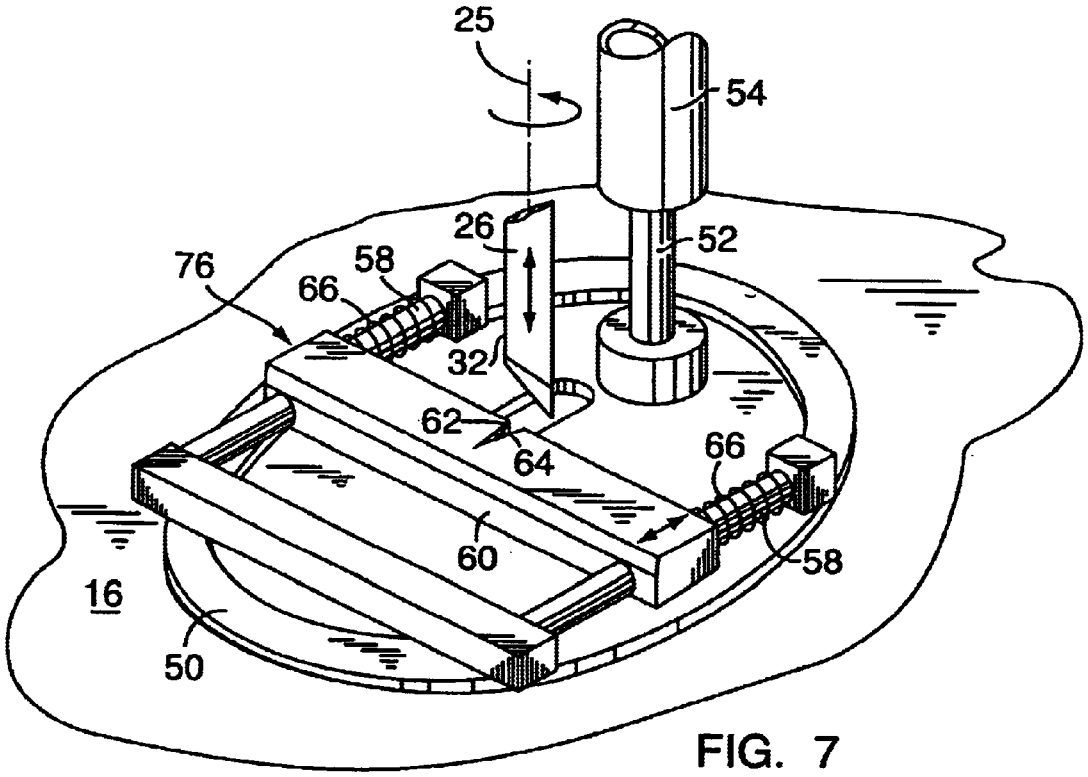
FIG. 7 is a partial perspective view of an embodiment of the secondary sharpening apparatus of the present invention.

The secondary sharpener shown in FIG. 7 and generally designated as 76, is similar in many respects to the secondary sharpener shown in FIG. 5, with the difference being that an actuating arm is not employed to move the sharpening member 60 into engagement with a portion of the cutting edge 32 of the blade 26. Instead, with the presser foot 50 in the raised non-working position, and the blade 26 in the raised position, the knife frame 24 is rotated about axis 25 so as to impart sufficient centrifugal force to the sharpening member 60, to overcome the force exerted on the sharpening member by the springs 66, and cause the sharpening member to engage the cutting edge 32 of the blade 26.

Figure 8:
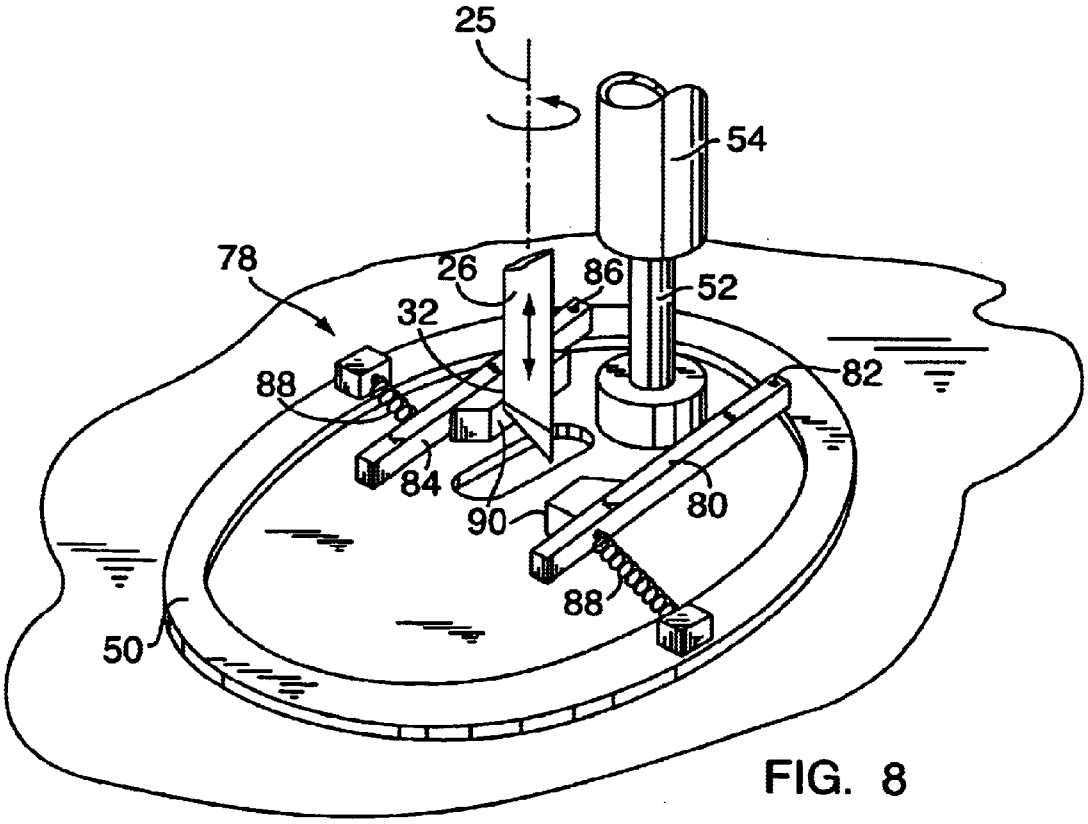
FIG. 8 is a partial perspective view of an embodiment of the secondary sharpening apparatus of the present invention.

Referring to FIG. 8, the secondary sharpener generally designated by the reference numeral 78 includes a first swing arm 80 pivotally mounted to the presser foot 50 for rotation about first pivot point 82, and a second swing arm 84 pivotally mounted to the presser foot for rotation about a second pivot point 86. A pair of springs 88, one coupled at one end to each of the first and second swing arms, 80 and 84 respectively, and at an opposite end to the presser foot 50 are provided to urge each swing arm away from the blade 26 during a cutting operation. A pair of sharpening blocks 90 are coupled, one to each of the swing arms, adjacent to the edge surfaces 28 and 30.

A secondary sharpening operation is performed by raising the blade 26, and the presser foot 50 to the non-working positions. The presser foot 50 is rotated in a first rotational direction about the axis 25 to generate centrifugal force of sufficient magnitude to cause one of the sharpening blocks 90 to overcome the force exerted by the spring 88 and contact a portion of one of the edge surfaces 28 or 30. The blade 26 is reciprocated while the sharpening block 90 is in contact with the portion of the edge surface until that portion is sharpened. The presser foot 50 is then rotated in a second coordinate direction to generate centrifugal force of sufficient magnitude to cause the other of the sharpening blocks 90 to overcome the force exerted by the spring 88 and contact a portion of the other of the edge surfaces 28 or 30. The blade 26 is again reciprocated while the sharpening block 90 is in contact with the portion of the edge surface until that portion is sharpened.

Figure 9:
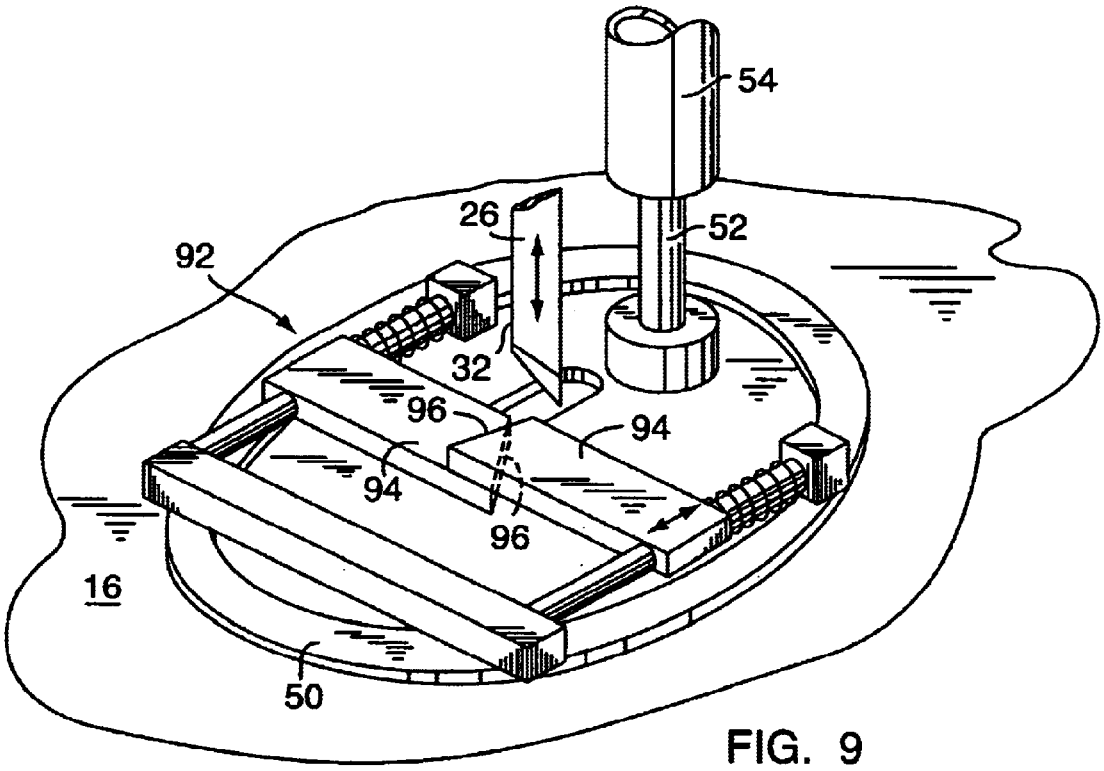
FIG. 9 is a partial perspective view of an embodiment of the secondary sharpening apparatus of the present invention.

As shown in FIG. 9, the secondary sharpener generally designated as 92 includes two sharpening members 94, spaced one-above-the-other. Each sharpening member 94 defines a face 96 engageable with a respective one of the two cutting surfaces and extending both inwardly of and outwardly from the cutting edge 32 of the blade 26. During a secondary sharpening operation, the faces 96 are brought into engagement with a portion of the cutting edge 32 of the blade 26 as the blade reciprocates, by one of the aforementioned actuation means, to sharpen the cutting edge.

While preferred embodiments have been shown and described, various modifications and substitutions may be made without departing from the spirit and scope of the invention. Accordingly, it is to be understood that the present invention has been described by way of example, and not by limitation.

What is claimed is:

1. A sheet material cutting apparatus comprising:

a support frame having a work supporting surface;

a cutting head coupled to said support frame adjacent to said work supporting surface and including a rotatable knife frame having a presser foot movably coupled thereto for movement between a working position and a non-working position relative to said knife frame, said knife frame being rotatable relative to said support frame;

an elongated blade having cutting surfaces defining a vertically extending cutting edge and coupled to said knife frame for reciprocation relative to said knife frame to cut sheet material supported on said work supporting surface;

a primary sharpener coupled to said knife frame and selectively engageable with the elongated blade for removing material therefrom during a primary sharpening operation; and a secondary sharpener coupled to said presser foot and fixed in a generally vertical direction with respect to said presser foot for movement therewith in said generally vertical direction, said secondary sharpener including a sharpening surface movable in a generally horizontal direction with respect to said presser foot for movement relative to said presser foot in said generally horizontal direction to selectively engage said blade during a secondary sharpening operation, and wherein the secondary sharpener further includes a biasing member coupled to said sharpening surface and biasing said sharpening surface away from said blade, whereby the secondary sharpener can be spaced from the blade when said presser foot is in the working position.

2. A sheet material cutting apparatus as defined by claim 1, comprising: said secondary sharpener being generally vertically movable with respect to said primary sharpener.

3. A sheet material cutting apparatus as defined by claim 1, wherein:

said cutting edge is defined by two intersecting cutting surfaces;

said primary sharpener is engageable with at least one of said cutting surfaces; and said secondary sharpener is engageable with both of said two cutting surfaces.

4. A sheet material cutting apparatus as defined by claim 3, wherein said secondary sharpener is defined in part by a monolithic sharpening member having said sharpening surface thereon, and said sharpening surface comprises a V-shaped notch of a shape complementary to said cutting edge of said blade.

5. A sheet material cutting apparatus as defined by claim 1, further comprising a controller wherein the primary sharpener is in communication with the controller and includes at least one abrasive grinding wheel coupled to said knife frame adjacent to said cutting edge, said abrasive grinding wheel being selectively engageable with said cutting edge during reciprocation of said blade for removing material therefrom, and sharpening said cutting edge in response to commands issued from the controller.

6. A sheet material cutting apparatus as defined by claim 1, wherein said secondary sharpener further comprises:

a sharpening member having said sharpening surface thereon and slideably coupled to said presser foot adjacent to said cutting edge;

actuating means for moving said sharpening member into sharpening engagement with said blade such that said sharpening surface engages at least a portion of at least one of said cutting surfaces when said presser foot is in said non-working position.

7. A sheet material cutting apparatus as defined by claim 6, wherein said actuating means includes a solenoid.

8. A sheet material cutting apparatus as defined by claim 6, said actuating means includes a pneumatic cylinder.

9. A sheet material cutting apparatus as defined by claim 6, wherein said actuating means includes a hydraulic cylinder.

10. A sheet material cutting apparatus as defined by claim 1, wherein said secondary sharpener includes a sharpening member having said sharpening surface thereon and further includes at least one guide member coupled to said presser foot, said sharpening member being slidably engaged with said guide member for movement between a sharpening and a non-sharpening position.

11. A sheet material cutting apparatus as defined by claim 10, wherein said guide member further includes a rod and said sharpening member defines an aperture extending therethrough, said aperture slidably receiving said rod; and wherein said biasing member is a spring slidably positioned over said rod and between said sharpening member and said presser foot for urging said sharpening member away from said cutting edge during a cutting operation.

12. The sheet material cutting apparatus of claim 1 wherein said secondary sharpener does not rotate relative to said blade when engaged with at least one of said cutting surfaces.

13. The sheet material cutting apparatus of claim 1 wherein said secondary sharpener remains stationary relative to said knife frame when engaged with at least one of said cutting surfaces that defines a leading edge of said elongated blade.

* * * * *